US007955229B2

(12) United States Patent
Graham

(10) Patent No.: US 7,955,229 B2
(45) Date of Patent: Jun. 7, 2011

(54) PORTABLE THERAPEUTIC EXERCISE DEVICE

(76) Inventor: Gary Graham, Glacier, WA (US)

( * ) Notice: Subject to any disclaimer, the term of this patent is extended or adjusted under 35 U.S.C. 154(b) by 0 days.

(21) Appl. No.: 12/698,373

(22) Filed: Feb. 2, 2010

(65) Prior Publication Data

US 2010/0216612 A1 Aug. 26, 2010

Related U.S. Application Data

(60) Provisional application No. 61/154,482, filed on Feb. 23, 2009.

(51) Int. Cl.
*A63B 21/00* (2006.01)

(52) U.S. Cl. ..... 482/70; 482/72; 482/65; 482/121

(58) Field of Classification Search ..... 482/70–72, 482/65, 121

See application file for complete search history.

(56) References Cited

U.S. PATENT DOCUMENTS

| | | | | |
|---|---|---|---|---|
| 4,653,749 | A * | 3/1987 | Rorabaugh | 482/71 |
| 5,066,005 | A | 11/1991 | Luecke | |
| 6,042,523 | A * | 3/2000 | Graham | 482/121 |
| 6,099,445 | A * | 8/2000 | Rovinsky et al. | 482/121 |
| 6,527,685 | B2 * | 3/2003 | Endelman et al. | 482/121 |
| 2002/0137604 | A1 * | 9/2002 | Chen | 482/95 |
| 2004/0235623 | A1 * | 11/2004 | Martinez | 482/94 |
| 2005/0250621 | A1 * | 11/2005 | Corbalis et al. | 482/52 |

* cited by examiner

*Primary Examiner* — Jerome W Donnelly
(74) *Attorney, Agent, or Firm* — Dwayne E. Rogge; Hughes Law Firm, PLLC

(57) ABSTRACT

The present disclosure relates to a portable therapeutic exercise device and more particularly a convenient exercise device, which is particularly adapted for restoring and/or maintaining the range of motion of post-operative patients and also having general therapeutic use. The disclosed device has several significant and novel improvements over prior art devices. Several improvements have resulted in a device which is much easier and less expensive to produce, lighter, more convenient to transport and to store. The device has a lightweight base frame, and a moveable carriage connected thereto. A plurality of elastic members couple the base to the carriage to supply resistant force while in operation.

15 Claims, 14 Drawing Sheets

PORTABLE THERAPEUTIC EXERCISE DEVICE

RELATED APPLICATIONS

This application claims priority benefit of U.S. Ser. No. 61/154,482, filed Feb. 23, 2009.

BACKGROUND OF THE DISCLOSURE a) Field of the Disclosure

The present disclosure relates to a portable therapeutic exercise device and more particularly a convenient exercise device which is particularly adapted for restoring and/or maintaining the range of motion of post-operative patients and also having general therapeutic use. The disclosed device has several significant and novel improvements over prior art devices. Several improvements have resulted in a device which is much easier and less expensive to produce, lighter, more convenient to transport and to store.

b) Background Art

There have existed for a number of years exercise apparatus comprising a support frame, and a support platform which is movable along the length of the support frame. In one such apparatus, the user is often positioned with his or her back resting on the support frame and the user's feet are placed against an upright plate, and the user pushes with his or her legs to be propelled away from the plate. Tension cords are provided to pull the carriage back toward the plate, with a user again propelling their self away from the plate. There is currently a need for a portable exercise apparatus which is more adapted for therapeutic needs. For example, there is a current need for restoring and maintaining the range of motion for postoperative patients. Rapid functional improvement could be realized by lower extremity injury patients working on a horizontal, or near horizontal plane. By utilizing controlled concentric and eccentric chain exercises, the patient is able to focus on increasing his/her range of motion, strength and stability.

SUMMARY OF THE DISCLOSURE

The object of this disclosure in several forms has been designed particularly to serve the patient in the period between surgery and the point in rehabilitation when the patient's ability to bear partial weight is restored. Thus, it was developed to provide simple, quality movement, by range of motion, shortly after surgery and expand into a low-level exercise program. Also, the present device is arranged so that it could be used in a user's bed, on the floor, sitting in a chair or wheel chair, on a treatment table, or even a normal table.

Further, the object of this disclosure in one form can be used in a variety of clinical, institutional, athletic and specialized settings, enabling a wide variety of exercise to be accomplished with this apparatus.

The apparatus of the object of this disclosure in one form comprises a support frame having a front end, a rear end, and a longitudinal axis. The support frame comprises a longitudinally extending rail.

There is a carriage assembly in one form comprising a carriage unit, engaging the rail for back and forth travel along the longitudinal axis of the support frame. The carriage assembly also comprises a contact plate mounted to the carriage unit and adapted to be engaged by a user to exert a rearwardly directed force on the contact plate. The carriage assembly has a front end and a rear end.

There is also a tensioning system arranged for operative engagement between the carriage assembly and the support frame to exert an adjustable forward force on the carriage assembly to urge the carriage assembly in a forward direction. This tensioning system comprises a plurality of selectively operable elastic tension cords, each having an anchor end and an operating attachment end by which the operating end can be manipulated and attached.

The carriage assembly may also include a force gauge and readout coupled to the tensioning system, and actively measuring and displaying the force exerted by a user. This may be similar to a standard bathroom scale, and used to dynamically display the force exerted by the user on the contact plate.

There is a cord attaching system located at the forward end of the carriage assembly and comprising a first attaching portion to hold the anchor ends of the cords at a forward anchoring location on the carriage assembly and a second stowing attachment portion to engage selectively the operating attachment ends of the cords at selectively engaged stowing locations at the forward end of the carriage.

A pulley section at the rear end of the carriage unit comprises a plurality of pulleys, engaging related cords. The cords extend from the forward anchoring location rearwardly to extend around the related pulleys and then forwardly from the pulleys to a forward location of the carriage unit. There is a third selectively engaged operating attaching device mounted at a front end location of the support frame to connect selectively to the operating ends of the cords.

Thus, the operating ends of the cords can be attached to the second attaching portion of the cord attaching device so that the cords are in a stowed position in the carriage assembly, and one or more of the operating ends of the cords can be detached from the second attaching portion and engaged with the third selectively engaged operating attaching device. Thus, when a user is utilizing the apparatus by pushing against the contact member to move the carriage assembly rearwardly, the one or more tension cords attached to the third attaching device exert a tension force on the carriage assembly to return the carriage assembly to a more forward location.

In the preferred form, the contact member comprises a contact plate which is adjustably mounted to the carriage housing so as to be able to be positioned at various angular positions. The plate is pivotally mounted at the forward location of the carriage housing, and the plate can be moved angularly in an upward or downward direction from the pivot location. A plate positioning device holds a plate at selected angular locations.

The apparatus further comprises stabilizing cord device having one end attached to the support frame, and a second end having connecting device adapted to be connected to a stationary structure so as to position the apparatus at a stationary operating location. The stabilizing cord device comprises a pair of stabilizing cords connected at forward locations on the support frame on opposite sides thereof. In the preferred form, the stabilizing cords have a length and adjustment device incorporated therein so that the cords can be connected to structures adjacent to the user operating the exercise apparatus.

DESCRIPTION OF THE PREFERRED EMBODIMENTS

Figure 1:
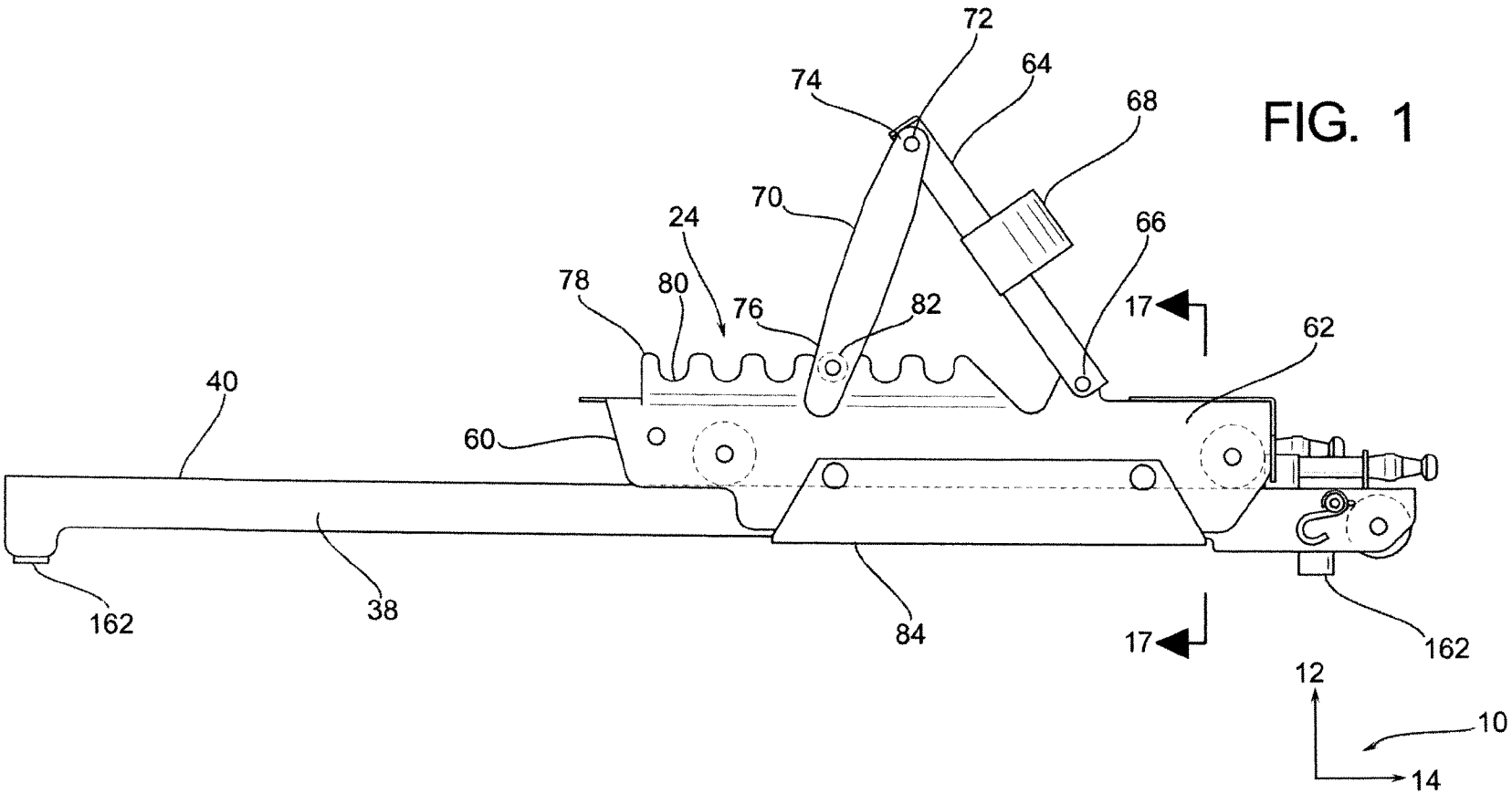
FIG. 1 is a side view of one embodiment of the disclosure.
Figure 2:
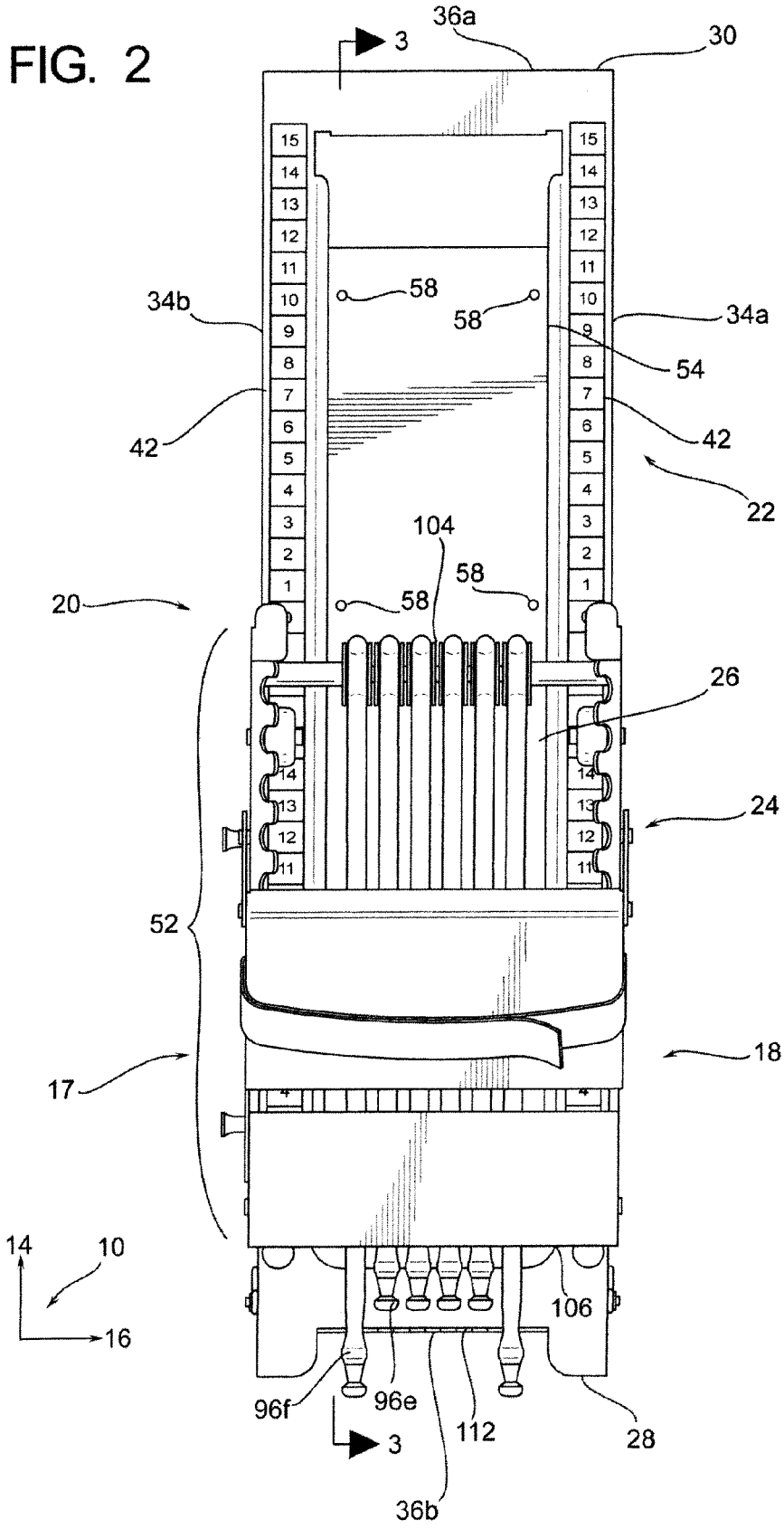
FIG. 2 is a plan view of one embodiment of the disclosure.

Before beginning, an axis system 10 is disclosed as shown in FIGS. 1 and 2. This axis system substantially comprises a vertical axis 12 and a longitudinal axis 14. As shown in FIG. 2, a transverse axis 16 extends substantially from the left side 17 to the right side 18. This axis system is disclosed for reference purposes only and is not intended to be limiting to the claims.

The therapeutic exercise device 20 as shown in FIG. 2, substantially comprises several interoperating assemblies including a support frame 22, and a carriage assembly 24. The carriage assembly 24 is configured to engage the support frame 22 in such a way as to limit transverse and vertical movement of the carriage assembly 24 relative to the support frame 22. Longitudinal movement of the carriage assembly 24 is only facilitated within a prescribed range. A tensioning system 26 is also disclosed, which substantially repositions the carriage assembly 24 to the front end 28 of the exercise device 20. In operation, a user will exert force upon the carriage assembly 24, repositioning it toward the back end 30 of the device 20, and the tensioning system will reposition the carriage assembly 24 back to the front end 28 of the device 20 when sufficient force is relieved.

Figure 26:
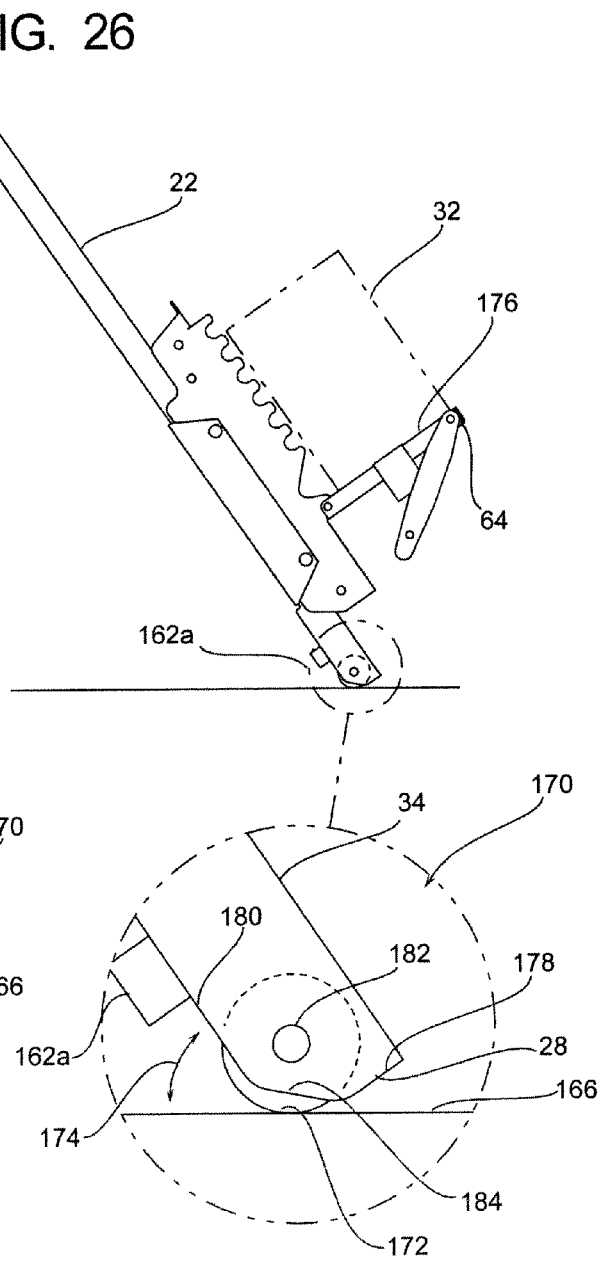
FIG. 26 is a side environmental view of one embodiment of the disclosure in a transporting orientation.

This device in one embodiment is similar to the embodiments shown in Applicant's own prior, U.S. Pat. No. 6,042,523, which is incorporated herein by reference. Some of the novel concepts and improvements of this disclosure allows the therapeutic exercise device 20 to be formed with fewer and lighter parts which increases portability of the overall device. This configuration also substantially reduces the cost of manufacture. As this device is often used by physical therapists, the device 20 can also be used as a hand truck-like device for carrying objects 32 as shown in FIG. 26. This arrangement will be described in much more detail later.

Figure 12:
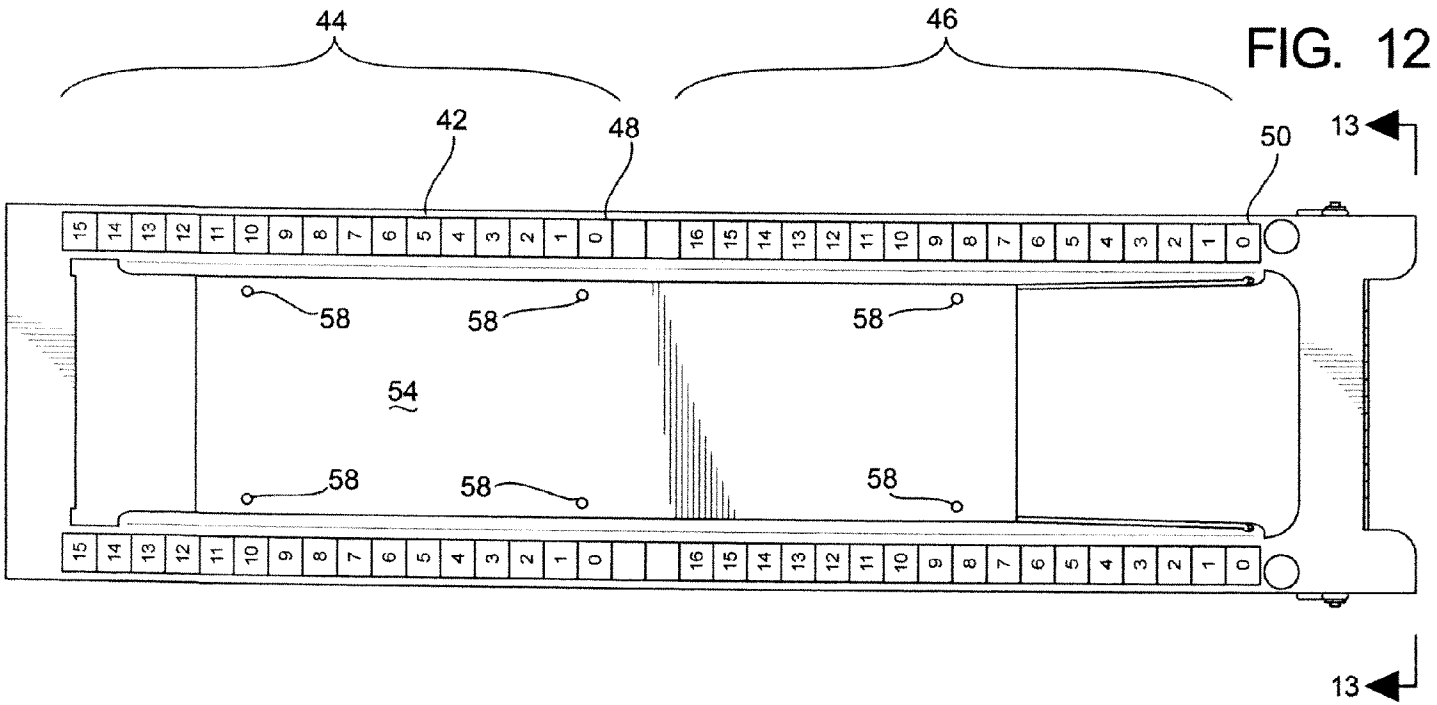
FIG. 12 is a plan view of one embodiment of the disclosure with the carriage assembly removed.
Figure 13:
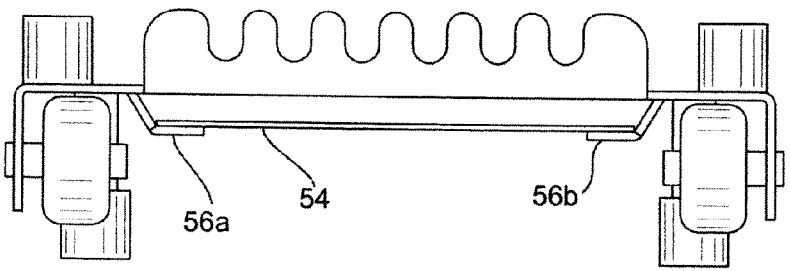
FIG. 13 is an end view of one embodiment of the disclosure taken along line 13 of FIG. 12.

Returning to FIG. 2, in one form the support frame 22 is comprised of several elements including a plurality of longitudinally extending side rails 34A and 34B. A transverse connector 36A connects the longitudinally extending side rails 34A and 34B at the back end 30 of the support frame 22. Another transverse connector 36B connects the longitudinally extending side rails 34A and 34B at the front end 28 of the support frame 20. Each of the side rails 34 includes a side surface 38 and a top surface 40 as shown in FIG. 1. The side surfaces 38 may be formed as a unitary structure with the top surface 40, which may increase rigidity and strength of the support frame 22 and at the same time, decrease the overall weight of the device 20 relative to previous embodiments. In one form, as shown in FIG. 2, a distance scale 42 is provided on at least one of the top surfaces 40. This distance scale 42 displays to the user, and alternatively a therapist, the range of motion through which the user is exercising. As shown in FIG. 12, the distance scale 42 may comprise a first scale 44 and a second scale 46 at opposite longitudinal ends of the frame 22. As the distance between the origins 48 and 50 is substantially the same as the length 52 (see FIG. 2) of the carriage assembly 24, this allows the user and other personnel to see the distance traveled, even when the carriage assembly 24 covers a portion of the distance scale 42. In one embodiment, an instruction plate 54 is provided which may be attached at a recess 56A and 56B, of the longitudinally extending side rails 34A and 34B as shown in FIGS. 12 and 13. The instruction plate 54 may include operating instructions and/or marketing information (not shown) to the exercise device. The recess 56 may also add rigidity and support to the overall design of the exercise device 20. To attach the instruction plate 54 to the recess 56, a plurality of openings 58 are provided as shown in FIG. 2 and again in FIG. 12 the instruction plate 54 can therefore be fixed to the recess 56 by way of screws, bolts, rivets, adhesives or equivalents.

Figure 5:
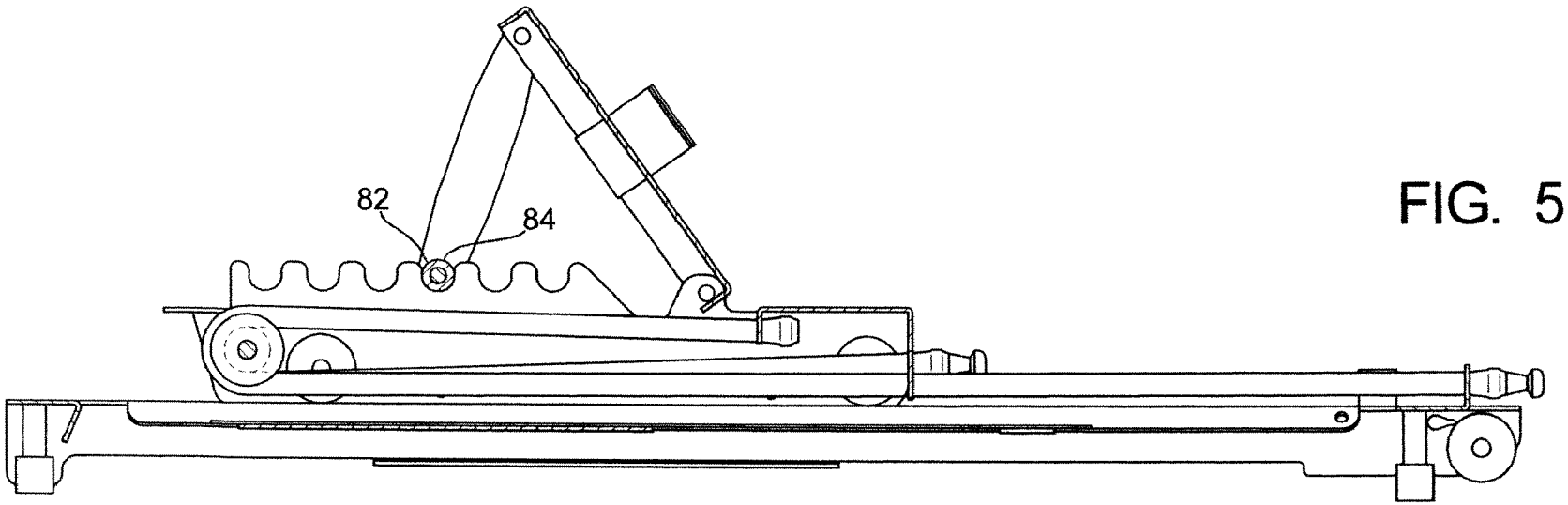
FIG. 5 is a cutaway view of the embodiment as shown in FIG. 4.
Figure 6:
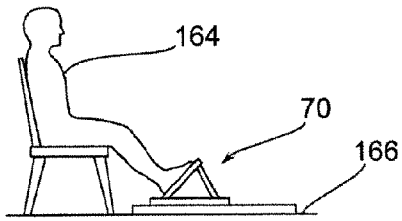
FIGS. 6 through 10 depict several embodiments of exercises which can be accomplished using one embodiment of the disclosure.
Figure 7:
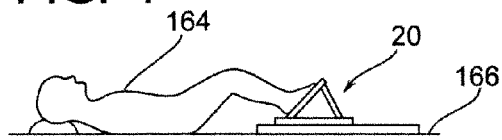
Figure 8:
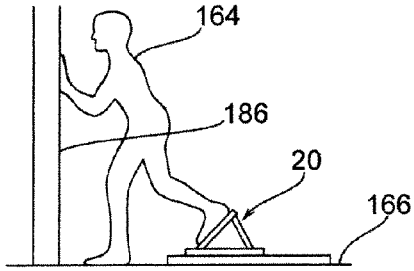
Figure 9:
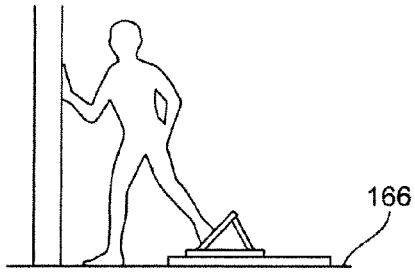
Figure 15:
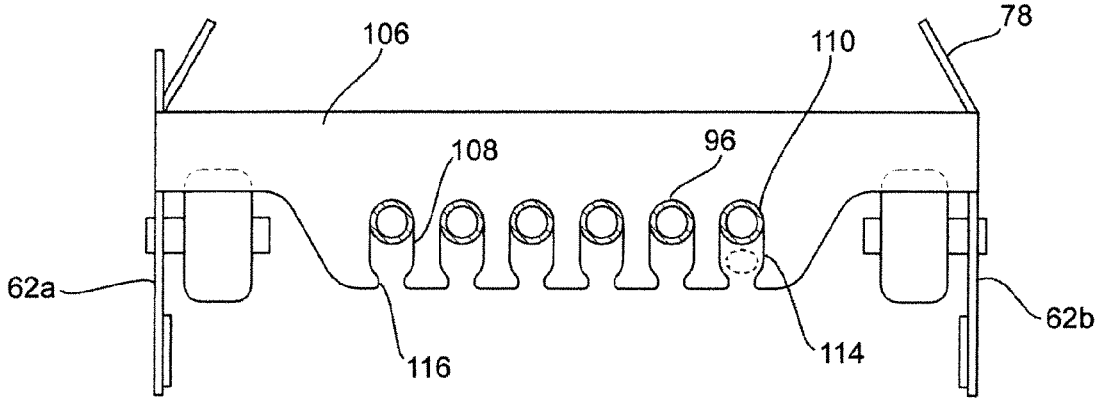
FIG. 15 is a cutaway view of one embodiment the disclosure taken along line 15 of FIG. 14.
Figure 16:
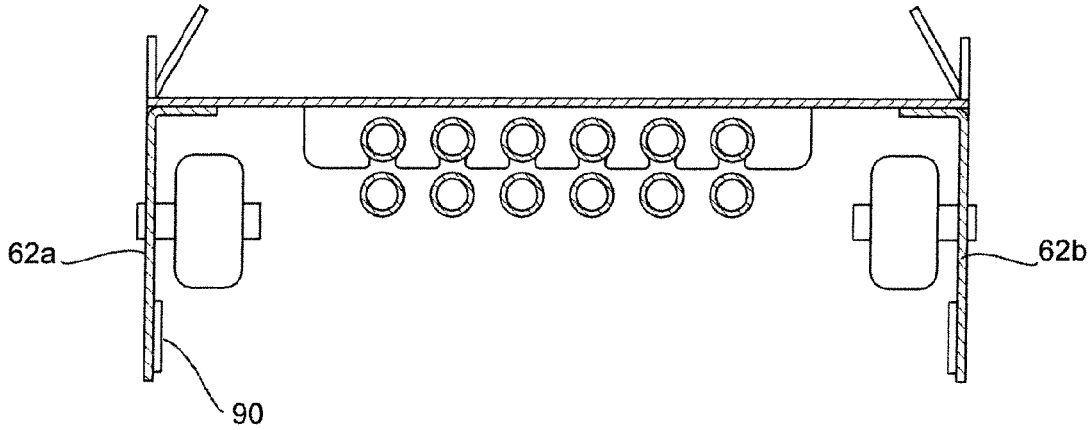
FIG. 16 is a cutaway view of one embodiment of the disclosure taken along line 16 of FIG. 14.

The carriage assembly 24 comprises several interoperating portions. Beginning with FIG. 1, the carriage assembly 24 comprises a carriage body 60 comprising a plurality of carriage side plates 62 including, as shown in FIG. 15, a left side plate 62A and a right side plate 62B. Back to FIG. 1, a contact plate 64 is provided which is pivotably attached to the carriage assembly 24 at a carriage plate pivot 66. This allows the contact plate 64 to be pivotably adjusted relative to the carriage body 60. In one form, a restraining strap 68 is provided which is utilized to retain a user's feet or other appendage upon the contact plate 64 when the device 20 is in operation. The contact plate may further comprise further a force gauge and readout operatively configured to actively measure and display the force exerted by a user on the carriage assembly. A contact plate support 70 is also provided which is pivotably connected to the contact plate 64 at a contact plate support pivot 72 at a first end 74 of the contact plate support 70. The second end 76 of the contact plate support is operatively configured to engage an angle adjustment system 78 provided on the carriage body 60. In one form, the angle adjustment system 78 comprises a plurality of recesses 80 which are formed upon the carriage side plate 62 to engage a transverse rod 82. Looking to FIG. 5, it can be seen how in one form, the transverse rod 82 may further comprise an outer surface 84 which in one form is a padded portion.

In one form, the carriage plate pivot 66 of FIG. 1, is created with sufficient friction between the contact plate 64 and the carriage body 60 that substantial force is required to reposition the contact plate 64 relative to the carriage body 60. This will keep the contact plate 64 from inadvertently readjusting during operation. Additionally, it may be desired that the contact plate support pivot 72 be similarly formed.

Figure 17:
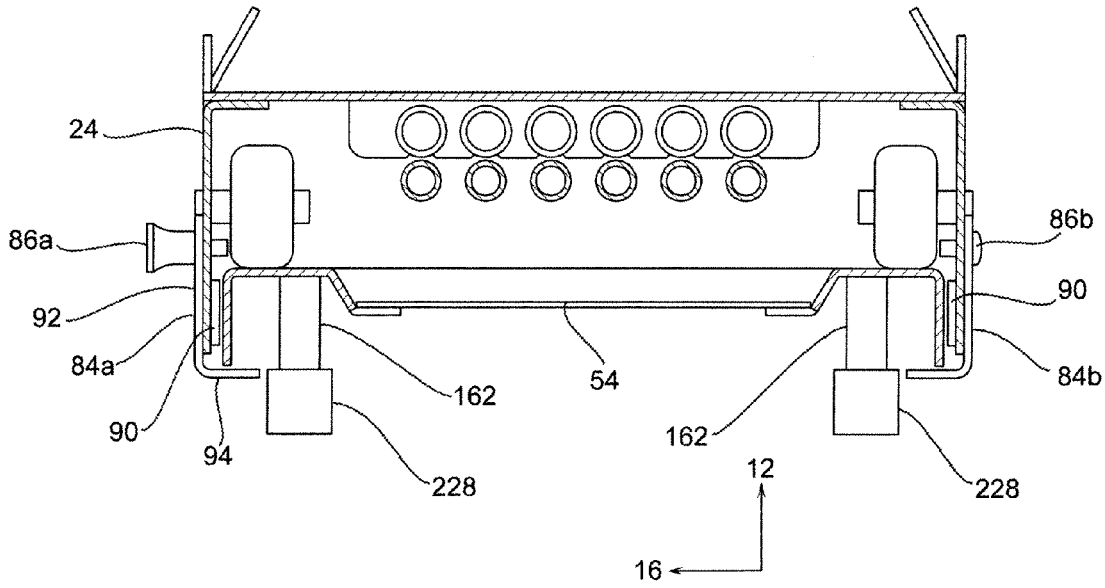
FIG. 17 is a cutaway view of one embodiment of the disclosure taken along the line 17 of FIG. 1.
Figure 18:
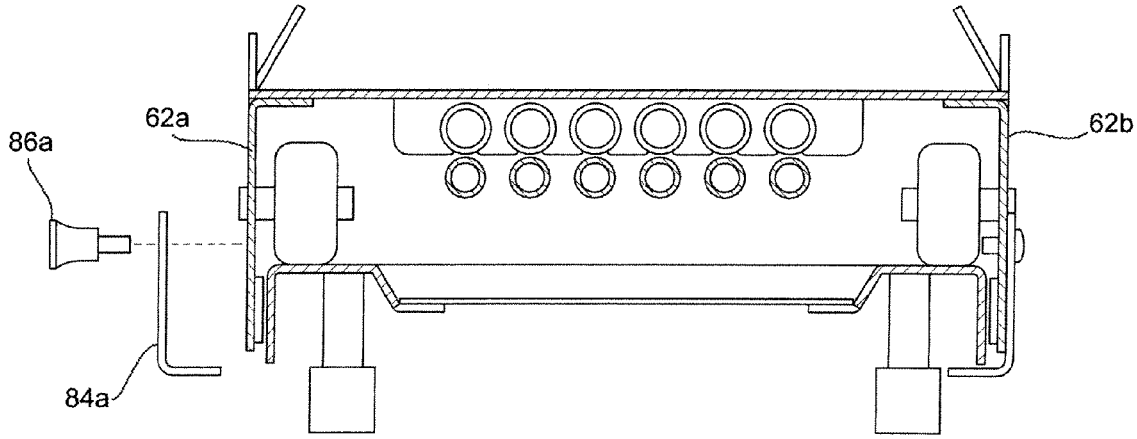
FIG. 18 is a cutaway view of one embodiment of the disclosure as shown in FIG. 17 with one side plate being removed.
Figure 19:
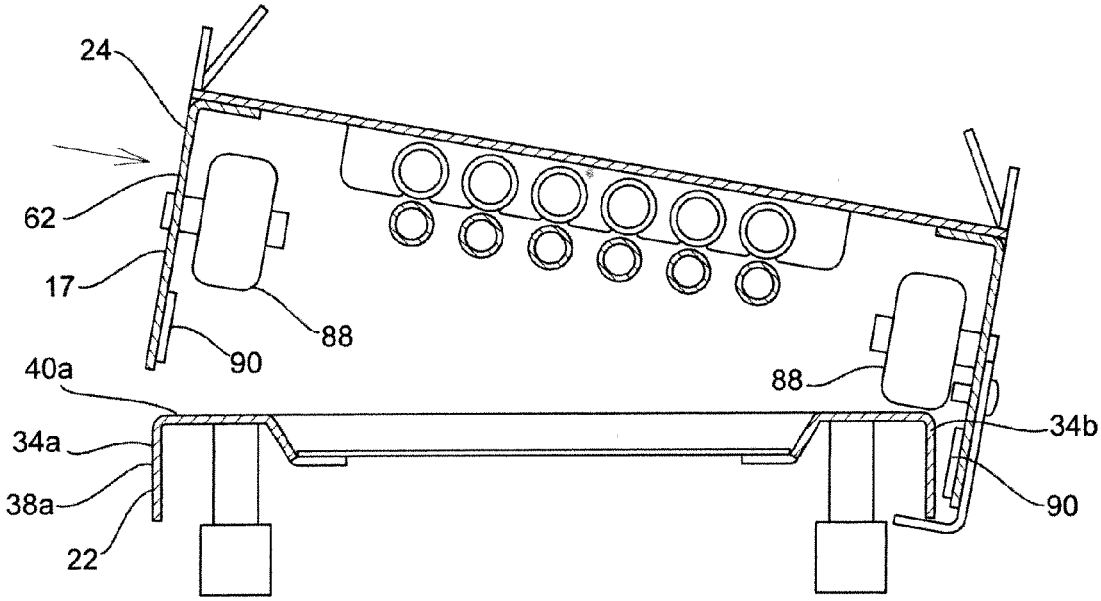
FIG. 19 is a cutaway view of one embodiment of the disclosure with one side plate removed and the carriage assembly being removed from the support frame.

It may be desired to have the carriage assembly 24 removable from the support frame 22 in the field. As physical therapists would not ordinarily carry with them a set of tools, an embodiment is disclosed wherein the carriage assembly 24 comprises a plurality of side plates 84A and 84B as shown in FIGS. 17 and 18. In one form, the right and left side plates 84A and 84B may be substantially identical or mirror images of each other save for a fastener 86A being a removable fastener, and the alternate fasteners 86B being non-removal fasteners. Thus as shown in FIG. 18, the removable fastener 86A can be de-coupled from the side plate 84A and the carriage side plate 62A. Thus as shown in FIG. 19, the carriage assembly 24 can be removed from the support frame 22 by simply lifting upon the left side 17 of the carriage assembly 24. This allows access to the wheels 88 and other portions of the undercarriage of the carriage assembly 24 as well as the entire top surface 40 of the support frame 22 for cleaning or maintenance.

In one embodiment, as shown in FIG. 19, the longitudinally extending side rails 34A and 34B, as previously discussed, are formed of a top surface 40 and a side surface 38. The wheels 88 of the carriage assembly 24 in one form ride upon the upper surface of these rails 34 in an oscillating, back-and-forth motion. In one form, a slide block 90 is provided on the interior surface of the carriage side plate 62 to frictionally engage the side surface 38 of the longitudinally extending rail 34. This slide block 90 may be formed of a friction-reducing material or compensation such as Delran, nylon, lubricant, Teflon, or equivalent materials and structures. As shown in FIG. 17, the side plates 84A and 84B in one form are comprised of a vertical portion 92 and a substantially horizontal portion 94. The vertical portion 92 in combination with the slide block 90 prevents the carriage assembly from substantially repositioning in a transverse direction 16 relative to the support frame 22. The horizontal portion 94 substantially limits the carriage assembly from substantially repositioning in a vertical direction 12 relative to the support frame 22. The side plates 84 may be formed of the same material as other portions of the device 20, or may alternatively be formed of a lighter structure, such as plastic, as the stress encountered by these portions is substantially less than, for example, the longitudinally extending rail or the contact plate. While the side plates 84 are shown engaging the outer portion of the support frame 22, it would also be possible to have these side plates engage the inner portion if the instruction plate 54 were removed.

Figure 3:
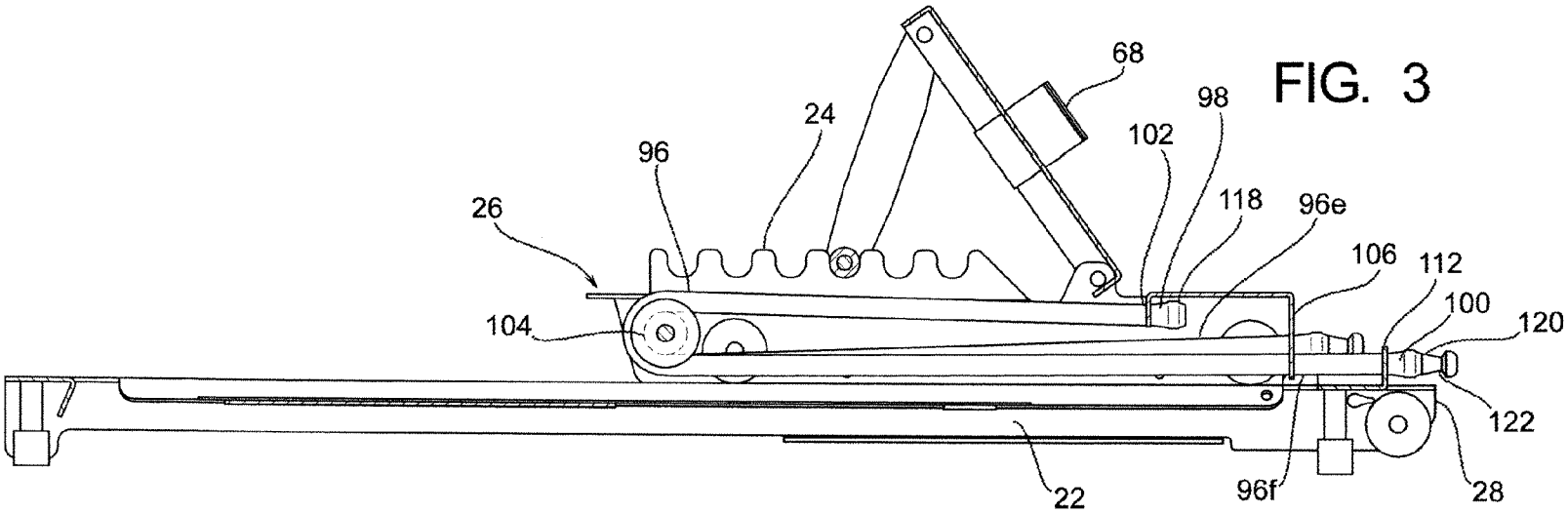
FIG. 3 is a cutaway view of one embodiment of the disclosure taken along line 3 of FIG. 2.
Figure 4:
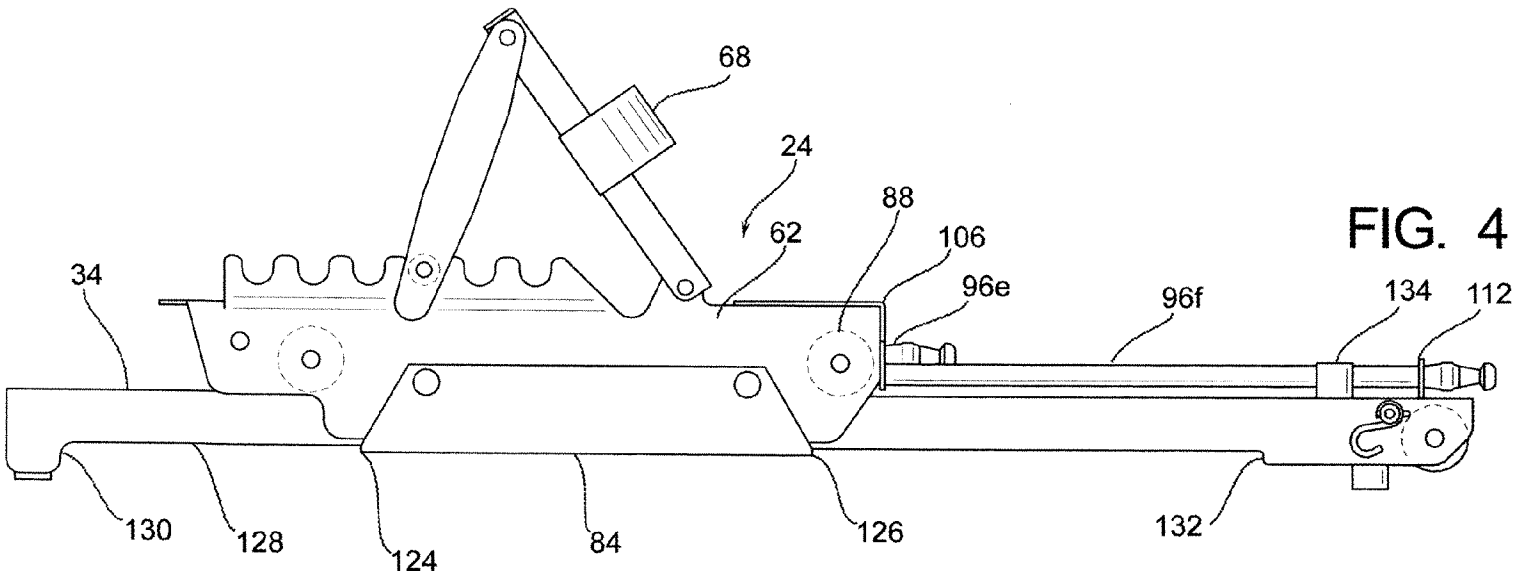
FIG. 4 is a side view of one embodiment of the disclosure in an extended orientation.
Figure 29:
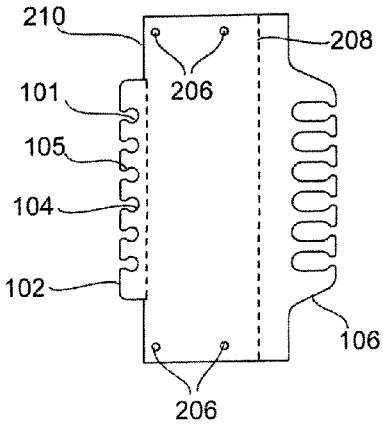
FIG. 29 is a plan view of a sheet of material forming one embodiment of a transverse carriage plate.

Referring now to FIG. 3, the resistance or tensioning system 26 is shown in a cutaway view taken along line 3 of FIG. 2. The tensioning system 26 comprises several parts, in one form a plurality of elastic members 96 which comprise an anchor end 98 and an operating attachment end 100. In one form, the anchor end 98 is fixed upon a rear cord anchor member 102 upon the carriage 24. This rear cord anchor member 102 is also shown in FIG. 29 wherein each anchor position comprises a substantially cylindrical portion 104 and a narrower portion 105. This configuration keeps the elastic members 96 in place; however, they can be removed when desired for maintenance or replacement. In its normal operating configuration as shown in FIG. 2, the anchor end 98 in one form is not accessible to the user. The previously described carriage removal process can be utilized to gain access to this anchor end 98. Looking again to FIG. 3, the elastic members 96 extend from the anchor end 98, around a plurality of pulleys 104, and back through the forward cord indexing member 106. The forward cord indexing member 106 as shown in FIG. 15 has a plurality of slots 108 through which the elastic members 96 pass. When a specific elastic member 96 is not engaged to add resistance to the device 20, it slides through the upper position 110. As shown in FIG. 3, when it is desired to have a specific elastic member 96 utilized for resistance, the operating attachment end is pulled toward the front end 28 of the support frame 22 and engaged upon the cord connecting member 112 of the support frame 22. As shown in FIGS. 3 and 4, at least one elastic member 96F is coupled to the cord connecting number 112, while at least one elastic member 96E remains attached to the forward cord indexing member 106. Even when the elastic member 96F, is attached to the cord connecting member 112, it may still pass through the slot 108 of the forward cord indexing member 106, but in the lower position 114, as shown in FIG. 15. The slot 108 also comprises an opening 116 such that the entire elastic member 96 can be removed without removing the end portions 118 or 120. The end portion 120 shown in FIG. 3, in one form further comprises a grasping portion 122 which improves the ability of a user to grab this portion of the elastic member 96. Where additional tension is desired in the apparatus, additional elastic members 96 can be engaged with the cord connecting member 112.

In FIG. 4 it can be seen how the side plate or carriage retaining bracket 84 has a back edge 124 and a front edge 126. In one form, the longitudinally extending side rail 34 further comprises a recess 128 extending from a rear edge 130 to a front edge 132. Thus, the carriage assembly 24 is allowed to oscillate between a position wherein the back edge 124 of the retaining bracket 84 abuts the back edge 130 of the recess 128, to a position wherein the front edge 126 of the carriage retaining bracket 84 abuts the front edge 132 of the recess 128. To reduce stress upon the carriage assembly 24 and more specifically the carriage retaining bracket 84, a bumper 134 may be provided. This bumper 134 can be bolted or otherwise affixed to the longitudinally extending side rail such that before the front edge 126 of the carriage retaining bracket 84 abuts the front edge 132 of the recess 128, a portion of the carriage assembly 24 will encounter the bumper 134. The bumper 134 may for example encounter the carriage side plate 62, the forward cord indexing member 106, or alternatively one of the wheels 88.

Figure 20:
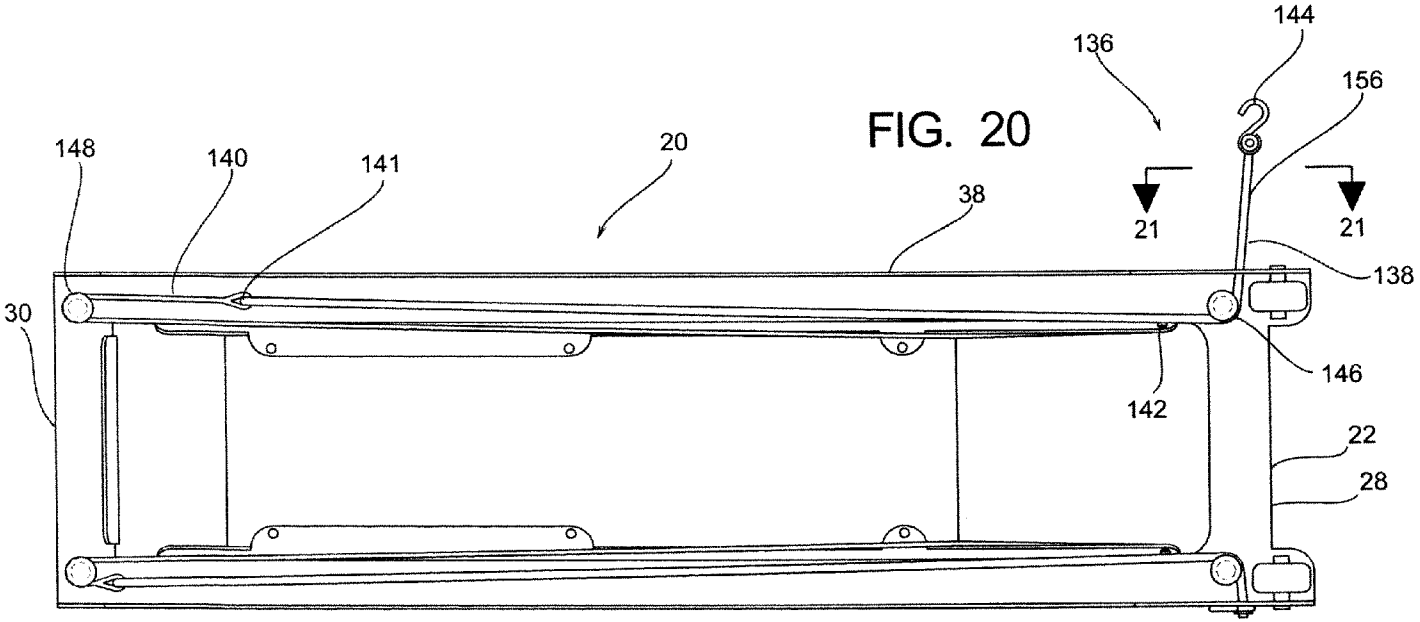
FIG. 20 is a bottom view of one embodiment of the disclosure showing one embodiment of the restraining system.

To increase the stability of the overall device 20 in operation, a restraining system 136 is disclosed in one form as shown in FIG. 20. The restraining system 136 substantially comprises, on each side of the apparatus, a non-elastic cord section 138 coupled to an elastic cord section 140. The elastic cord section 140 may terminate at an attachment location 142 on the support frame 22. A hook 144 or similar device may be attached to the non-elastic cord section. As will be described later, the non-elastic cord section 138 passes through the side surface 38 of the support frame 22 and then passes around a turning block 146 and travels down toward the back end 30 of the device 20 and couples to the elastic cord section 140 at attachment point 141. The restraining system then passes around a second turning block 148 disposed at the back end 30 of the device 20 wherein it returns toward the front end 28 terminating at the attachment location 142. This arrangement allows the hook 144 and non-elastic cord section 138 to be pulled outward from the side surface 38 to a desired extended length. When released, the restraining system 136 retracts the extended portion substantially back into the inside portion or enclosed portion of the support frame 22.

Figure 22:
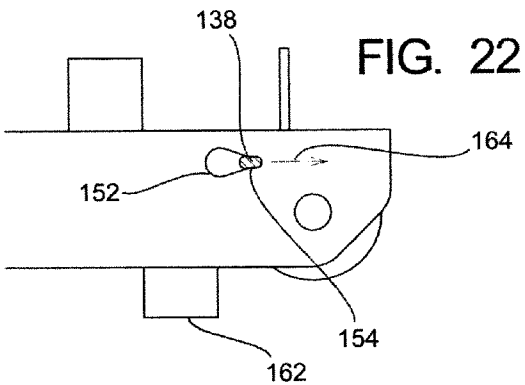
FIGS. 21 and 22 are detailed views of a portion of one embodiment of the restraining system in operation.
Figure 21:
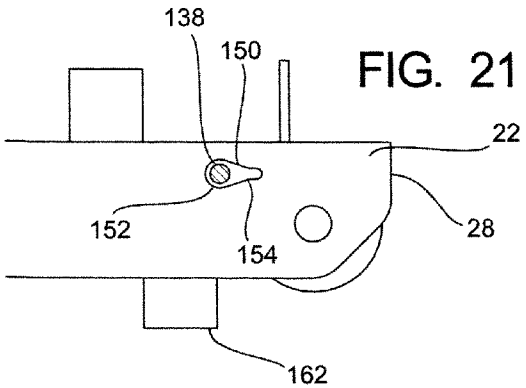
Figure 23:
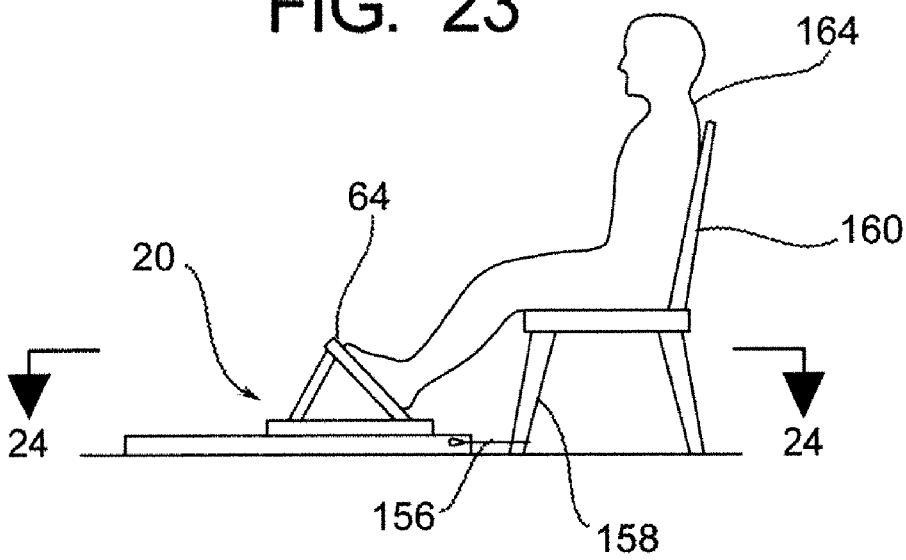
FIG. 23 is a side environmental view of one embodiment of the disclosure in operation.
Figure 24:
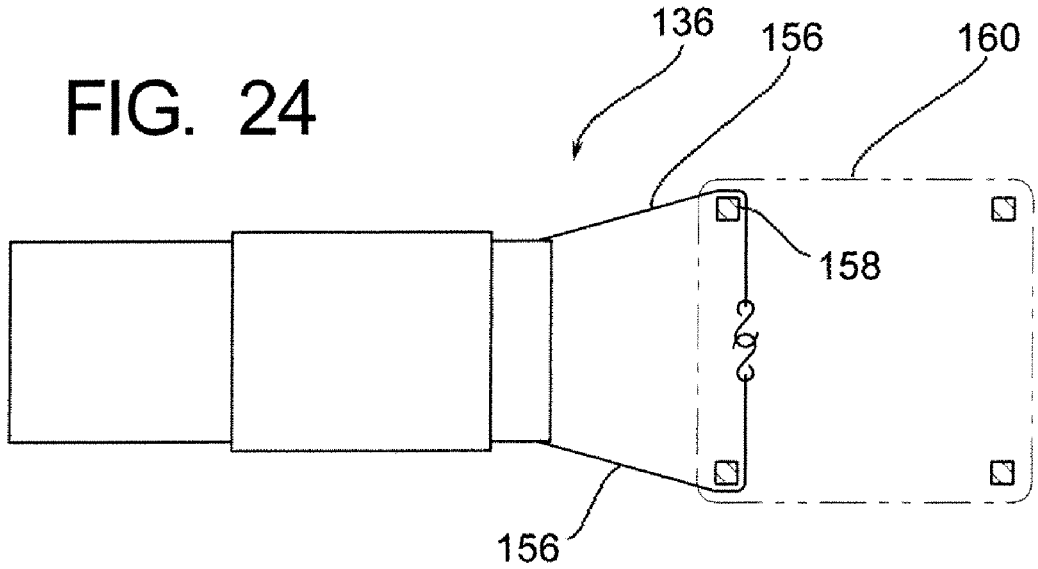
FIG. 24 is a plan view of one embodiment of the disclosure taken along line 24 of FIG. 23

In one form, the non-elastic cord section 138 passes through the side surface 38 through a keyway 150 as shown in FIG. 21. The keyway 150 substantially comprises two regions, one being a wide region 152 and the second being a narrow region 154. The narrow region 154 is generally closer to the front end 28 of the support frame 22. This arrangement allows the non-elastic cord section 138 and hook 144 to be pulled outward as shown in FIG. 20; however, as the extended portion 156 is pulled to couple to a stationary structure, for example, to wrap around the legs 158 of a chair 160 as shown in FIGS. 23 and 24, the extended portion 156 will tend to reposition toward the narrow portion 154 of the keyway 150 as shown in FIG. 22. In this orientation, a forward force vector 164 tends to lock the extended portion 156 into the narrow portion 154 of the keyway 150, fixing its relative position. The elastic cord sections 140 will tend to pull the extended portion 156 back into the support frame 22 and thus creates sufficient tension against the legs 158 to retract any slack in the extended portion 156. This restraining system 136 is utilized primarily because the weight of the therapeutic exercise device 20 may not be sufficient to create sufficient frictional force between the support members 162 and the floor to overcome the force placed upon the contact plate 64 by a user 164 as they press toward the back end 30 of the support frame 22 as the device 20 is being utilized. Using the restraining system 136, this force exerted by the user is divided between the frictional engagement between the support members 162 and the floor, and the restraining system 136.

In one form, the support members 162 can simultaneously function as the turning blocks 146 and 148 previously described. A foot portion 228 as shown in FIG. 17 may be added to the support members 162 to enhance frictional stability in relationship to the floor. To enhance the ability of the turning blocks to rotate without undesired friction, the support members may be covered by a friction reducing element, such as a layer of Teflon or other material which may or may not be rotatable in relation to the underlying structure.

Figure 10:
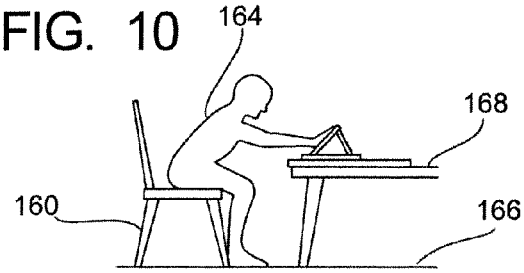
Figure 11A:
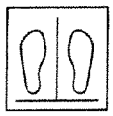
FIGS. 11*a* through 11*e* show several options of foot placement using one embodiment of the disclosure.
Figure 11B:
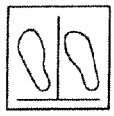
Figure 11C:
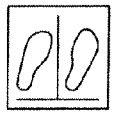
Figure 11D:
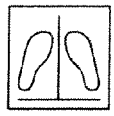
Figure 11E:
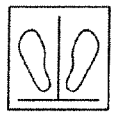

When the device 20 is in use, it will normally be desired to have each of the support members 162 in personal engagement with the floor 166 as shown in FIGS. 6 through 9, or possibly upon a tabletop 168 as shown in FIG. 10.

Figure 25:
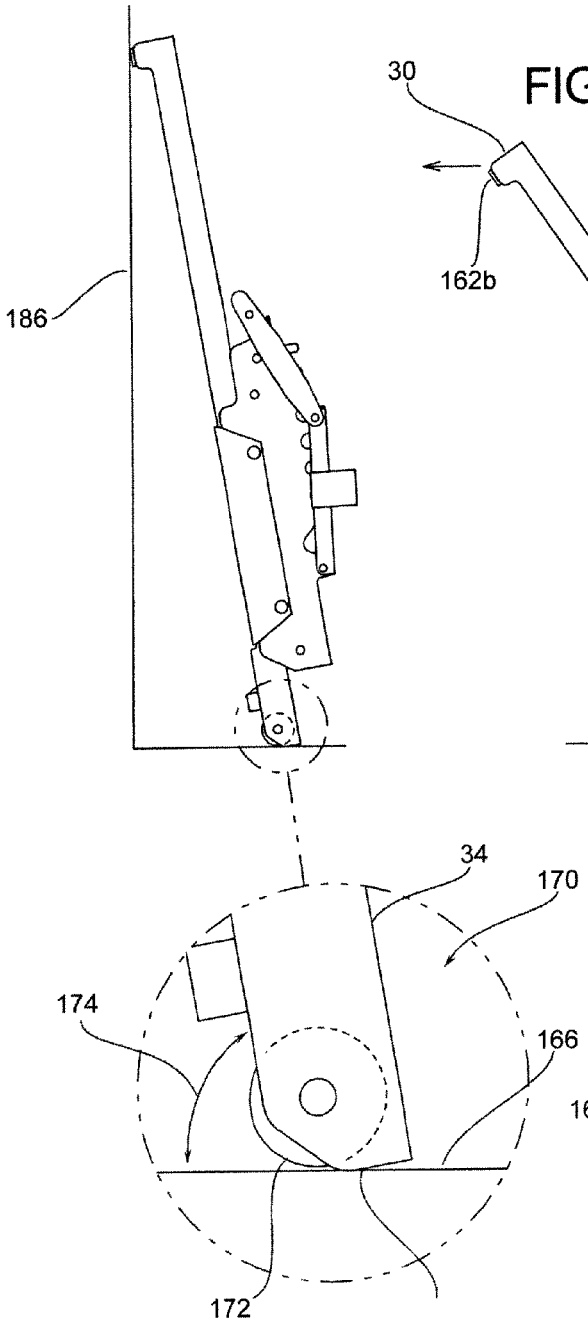
FIG. 25 is a side environmental view of one embodiment of the disclosure in an upright stored orientation.

In one embodiment, a rolling system 170 is provided, which comprises at least one floor engaging wheel 172 as shown in FIGS. 25 and 26. When the back end 30 of the therapeutic exercise device 20 is raised, the back support members 162B will no longer be in contact with the floor. Additionally, when the back end 30 is sufficiently lifted above the floor such that the support frame 22 is substantially above an angle 174 of 10°, the front support members 162A will also raise above any contact with the floor as the floor engaging wheels come into contact with the floor 166 as shown in the detail view of FIG. 26. The apparatus can be transported in the same way as a hand cart, wheeled luggage, or similar device. As shown in FIG. 26, one novel feature of this apparatus is that the contact plate 64 can be repositioned substantially 90° from the support frame 22, thus forming a shelf 176 for carrying objects 32. Looking to FIG. 2, it can be seen how the tensioning system 26 or a similar structure would function to maintain the object 32 upon the shelf 176. This can be very beneficial as a therapist moving from room to room, building to building, or vehicle to building would have a very convenient place to store other materials. In one form, the transverse connector 36A as shown in FIG. 2 may form a very convenient handle for such operation. Looking back to the detailed view of FIG. 26, it can be seen how the front end 28 of the longitudinally extending side rail 34 includes an end portion 178, and a bottom portion 180 with the axle 182 of the floor engaging wheel 172 angularly therebetween. To further facilitate use of the therapeutic exercise device 20 as a cart, the corner 184 is cut away to form an angled portion to leave more clearance for the floor engaging wheel 172. Looking now to the detailed view of FIG. 25, it can be seen how the therapeutic exercise device 20 may be arranged to store against a wall 186 or similar vertical structure. As the back end 30 of the therapeutic exercise device 20 is lifted such that the angle 174 is increased beyond, for example 80°, the end portion 178 of the longitudinally extending side rail 34 reengages the floor 166, raising the wheel 172 beyond contact with the floor 166. In this arrangement, the therapeutic exercise device 20 is in frictional engagement with the floor 166 and should not reposition without additional force outward from the wall.

Figure 27:
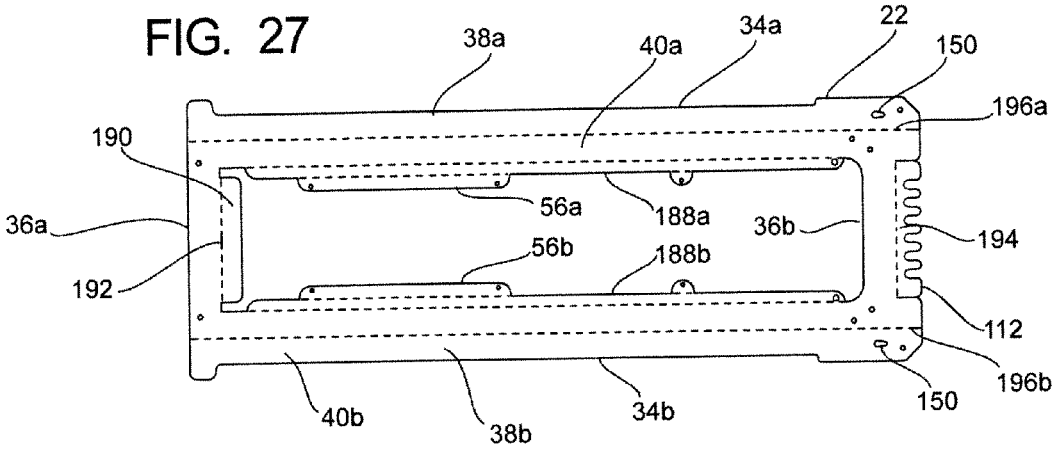
FIG. 27 is a plan view of a sheet of material forming one embodiment of the support frame body.

The embodiments disclosed herein lend themselves to a very simplistic manufacturing process wherein the major components can be formed quickly and easily using known methods, possibly from a single plate of material. Many types of material can be utilized, such as metal, plastic or equivalent materials having thicknesses in a wide range from 1/16 of an inch up to 1/4 of an inch and beyond. Additionally, this plate of material can be segregated into individual components by cutting, punching or possibly by forming the material from a mold. Tests have shown that cutting this material using a laser punch results in a product which requires very little in the way of final finishing. As shown in FIG. 27, the support frame 22 can be formed as a unitary structure comprising each of the longitudinal extending side rails 34A and 34B, the transverse connector 36A and the transverse connector 36B. The cord connecting member 112 can be formed at the same time, as well as the recess portions 56A and 56B, which are connected to the longitudinally extending side rails 34A and 34B by extensions 188A and 188B. Once the support frame 22 is cut out substantially as shown, it may be desired to include a transverse support 190 which is formed by folding along a transverse support fold line 192. Additionally, the cord connecting member 112 can be formed by folding along a transverse fold line 194. To differentiate the side surfaces 38A and 38B from the top surfaces 40A and 40B, the support frame 22 may be bent along a longitudinal fold line 196A and along a longitudinal fold line 196B. At the same time as the initial cutting, openings may be provided, such as the keyways 150 through which the restraining system 136 will extend.

Figure 14:
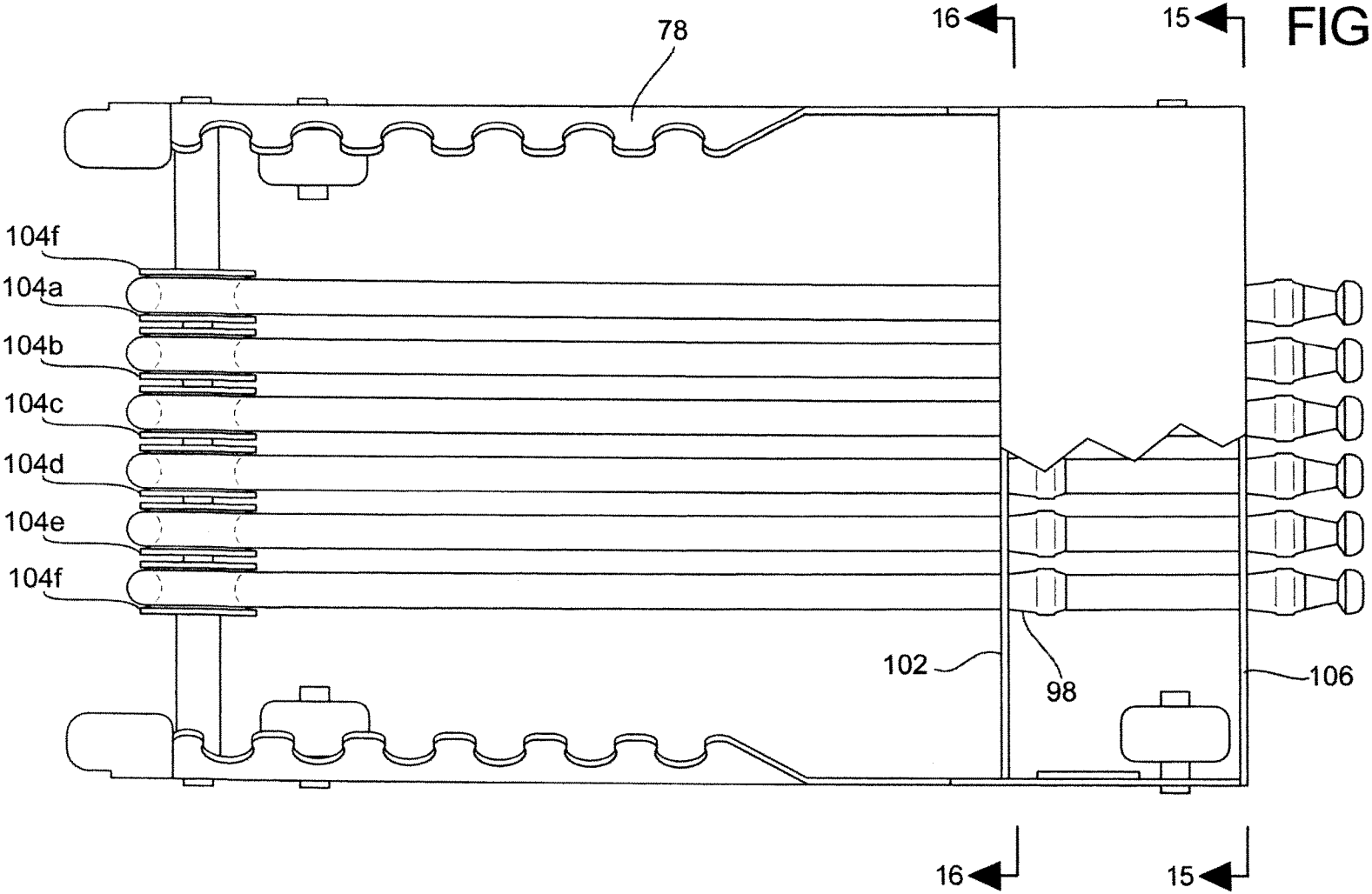
FIG. 14 is a partial cutaway view of one embodiment of the disclosure.
Figure 28:
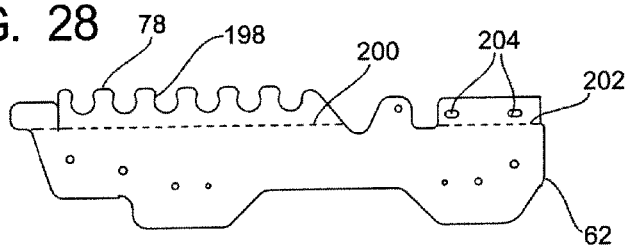
FIG. 28 is a plan view of a sheet of material forming one embodiment of a carriage side plate.

As shown in FIG. 28, the carriage side plate 62 can be formed simultaneously with a portion of the angle adjustment system 78 comprising a plurality of support engagement slots 198. To add rigidity to the carriage side plate 62, a portion comprising the angle adjustment system 78 can be folded along a longitudinal fold line 200. Looking to FIGS. 14 and 15, this bend may be a relatively slight angle, such as between 10° and 50° or thereabouts. It also may be desired to bend the carriage side plate 62 of FIG. 29 along a longitudinal fold line 202 for attachment of the forward cord indexing member 106.

Thus a plurality of openings 204 may be desired to correspond to a plurality of openings 206 in the forward cord indexing member 106 for attachment thereto. In one form, the carriage side plates 62 can be formed by the piece remaining from the central portion of the support frame 22. This will substantially reduce cost and waste. Furthermore, the portion cut to make the support engagement slots 198 may be used as washers or other needed elements on other parts of the apparatus.

As shown in FIG. 29, one embodiment of the transverse carriage plate 101 can be formed in a similar manner. Once cut, the transverse carriage plate 101 is folded along an indexing member fold line 208, thus differentiating the forward cord indexing member 106 from the remainder of the plate. Additionally, the transverse carriage plate can be folded along a cord anchor member fold line 210, thus differentiating the cord anchor member 102 from the remainder of the plate. These fold or bands also increase rigidity and stability of the transverse carriage plate 101.

Figure 30:
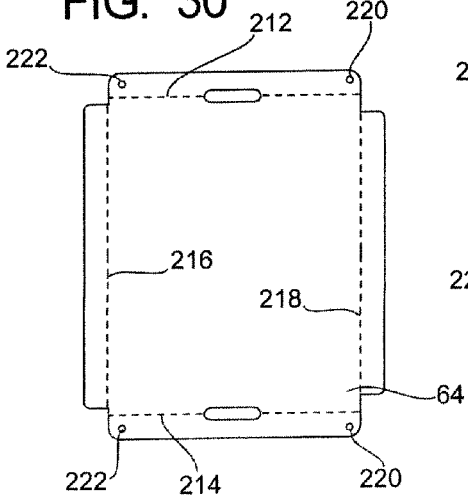
FIG. 30 is a plan view of a sheet of material forming one embodiment of a contact plate.
Figure 31:
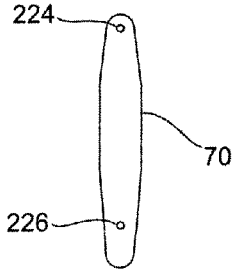
FIG. 31 is a plan view of a sheet of material forming one embodiment of a contact plate support.

As shown in FIG. 30, one embodiment of the contact plate 64 can be formed in a similar manner. Once cut, the contact plate 64 can be bent along a left fold line 212, and a right fold line 214. Additionally, for rigidity and support, the contact plate 64 can be bent along an upper fold line 216 and a lower fold line 218. Of course holes may be provided to lighten the contact plate 64 and/or additionally to provide fastening positions, such as openings 220, to form a portion of the contact plate pivot 66 previously discussed, as well as a plurality of openings 222 configured to engage openings 224 in the first end of the contact plate support 70 as shown in FIG. 31. These openings 222 and 224 form a portion of the contact plate support pivot 72 previously discussed.

The contact plate supports 70 as shown in FIG. 31 can be formed in a similar manner, including the portions previously discussed as well as an opening 226 operatively configured to engage the transverse support 82 previously discussed.

While the present disclosure is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The disclosure in its broader aspects is therefore not limited to the specific details, representative apparatus and methods, and illustrative examples shown and described. Accordingly, departures may be made from such details without departing from the spirit or scope of applicants' general concept.

Therefore I claim:

1. A portable exercise apparatus comprising:

a) a user portable support frame having a front end, a rear end, and a longitudinal axis, the support frame comprising a plurality of interconnected longitudinally extending rails each rail having a vertical side surface and a horizontal top surface;

b) a carriage assembly movably engaged with the support frame wherein:

the carriage assembly engages the horizontal top surface of the rails for oscillating travel along the longitudinal axis of the support frame;

a contact plate mounted to the carriage assembly and operatively configured to be engaged by a user;

c) the carriage assembly having a front end and a rear end the carriage assembly further comprising;

a carriage body;

a plurality of wheels coupled to the carriage assembly, the wheels in contact with, and supported by the horizontal top surface of the rails;

a tensioning system arranged for operative engagement between the carriage assembly and the support frame;

a plurality of side plates coupled to the carriage housing and engaging at least one vertical side of each rail to maintain the carriage assembly upon the support frame in the transverse and vertical directions;

d) the tensioning system comprising:

a plurality of selectively operable elastic tension cords;

a cord anchor member located on the carriage assembly;

a selectively engaged cord connecting member mounted on the support frame to selectively connect the operating ends of the cords to the support frame; and a forward cord indexing member located on the carriage assembly.

2. The exercise apparatus as recited in claim 1 further comprising a plurality of wheels coupled to the support frame operatively configured to engage a floor when the rear end of the exercise apparatus is lifted a substantial angle relative to the floor, and disengage the floor when lifted past a prescribed angle to the floor.

3. The apparatus as recited in claim 2, wherein the wheels coupled to the support frame are operatively configured to engage the floor, when the rear end of the exercise apparatus is lifted at least 10° relative to the floor, and disengage the floor when lifted substantially past 80° relative to the floor.

4. The exercise apparatus as recited in claim 1 wherein the plurality of interconnected longitudinally extending rails, and the selectively engaged cord connecting member mounted on the support are formed of a unitary structure.

5. The exercise apparatus as recited in claim 1 further comprising a force gauge and readout operatively configured to actively measure and display the force exerted by a user on the carriage assembly.

6. The apparatus as recited in claim 1, further comprising a restraining system comprising at least one stabilizing cord having a end attached to the support frame, and a end operatively configured to be connected to a stationary structure so as to position the apparatus to a stationary operating location; the restraining system operatively configured to retract within the support frame when tension is relieved from the stabilizing cords.

7. The apparatus as recited in claim 6 wherein the stationary structure is a chair.

8. The apparatus as recited in claim 1, wherein the carriage assembly further comprises at least one removable side plate operatively configured to limit transverse and vertical movement of the carriage assembly relative to the support frame wherein the removable side plate is operatively configured to be removed without tools.

9. The apparatus as recited in claim 8, wherein the plurality of wheels comprise left and right wheel sets on opposite transverse sides of the carriage unit to engage the horizontal top surfaces of the rails.

10. The apparatus as recited in claim 9, wherein the left and right wheel sets each comprises a plurality of longitudinally spaced support wheels which engage the horizontal top surface of at least one rail.

11. The apparatus as recited in claim 8, wherein the carriage further comprises first and second transversely spaced slide blocks having transversely directed contact surfaces to engage, respectively, at least one vertical side surface of the rails, the slide blocks functionally engaging the rails.

12. The apparatus as recited in claim 1, wherein the tensioning system comprises a cord connecting member provided at the front end of the support frame having attaching slots operatively configured to interoperate with an operating end of the cords, each attaching slot being sized to permit its related cord to pass therethrough, the operating end of each cord having an enlarged end portion which is sized to engage the edge portions of the attaching slots to attach the operating end of the cord to the attaching slots, the enlarged end portion operatively configured to removably retain the operating end of the cord at the position of the attaching slot.

13. The apparatus as recited in claim 12, wherein the tensioning system comprises a cord indexing member on the carriage assembly which is operatively configured such that with the operating end of its related cord being positioned in the indexing member, lateral and vertical movement of the cord is restricted by the indexing member.

14. The apparatus as recited in claim 13, wherein the indexing member on the carriage assembly is provided at a forward end of the carriage assembly, the indexing member comprise downwardly extending indexing slots, with the indexing slots being longitudinally aligned with the attaching slots on the support frame, the attaching slots upwardly open to receive the operating end of the cord.

15. A portable exercise apparatus comprising:

a) a support frame having a front end, a rear end, and a longitudinal axis, the support frame comprising a plurality of interconnected longitudinally extending rails each rail having a top surface;

b) a carriage assembly movably engaged with the support frame wherein:

the carriage assembly engages the top surface of the rails for oscillating travel along the longitudinal axis of the support frame;

a contact plate mounted to the carriage unit and operatively configured to be engaged by a user;

c) the carriage assembly having a front end and a rear end and comprising:

a carriage body;

a plurality of wheels coupled to the carriage housing, the wheels in contact with and supported by the top surface of the rails;

a tensioning system arranged for operative engagement between the carriage assembly and the support frame;

a plurality of side plates coupled to the carriage housing and engaging at least one rail to maintain the carriage upon the support frame in the transverse and vertical directions;

d) the tensioning system comprising:

a plurality of selectively operable elastic tension cords;

a rear cord fixing member located on the carriage assembly;

a selectively engaged operating attaching device mounted on the support frame to selectively connect the operating ends of the cords to the support frame;

e) a plurality of wheels coupled to the support frame operatively configured to engage a floor when the longitudinal end of the exercise apparatus is lifted a substantial angle relative to the floor, and disengage the floor when lifted past a prescribed angle to the floor.

* * * * *